US010670000B2

(12) United States Patent
Zug et al.

(10) Patent No.: US 10,670,000 B2
(45) Date of Patent: Jun. 2, 2020

(54) HYDROSTATIC POSITIVE-DISPLACEMENT MACHINE PISTON FOR THE HYDROSTATIC POSITIVE-DISPLACEMENT MACHINE, AND CYLINDER DRUM FOR THE HYDROSTATIC POSITIVE-DISPLACEMENT MACHINE

(71) Applicant: Robert Bosch GmbH, Stuttgart (DE)

(72) Inventors: Martin Zug, Hirrlingen (DE); Rene Scheerer, Freudenstadt (DE)

(73) Assignee: Robert Bosch GmbH, Stuttgart (DE)

( * ) Notice: Subject to any disclaimer, the term of this patent is extended or adjusted under 35 U.S.C. 154(b) by 126 days.

(21) Appl. No.: 16/008,212

(22) Filed: Jun. 14, 2018

(65) Prior Publication Data

US 2019/0003466 A1 Jan. 3, 2019

(30) Foreign Application Priority Data

Jun. 28, 2017 (DE) ..... 10 2017 210 857

(51) Int. Cl.

| | |
|---|---|
| ***F04B 1/126*** | (2020.01) |
| ***F04B 1/124*** | (2020.01) |
| ***F03C 1/28*** | (2006.01) |
| ***F03C 1/06*** | (2006.01) |
| ***F03C 1/32*** | (2006.01) |
| ***F04B 1/2035*** | (2020.01) |

(52) U.S. Cl.

CPC ..... *F04B 1/126* (2013.01); *F03C 1/0605* (2013.01); *F03C 1/0636* (2013.01); *F03C 1/0652* (2013.01); *F04B 1/124* (2013.01); *F04B 1/2035* (2013.01)

(58) Field of Classification Search

CPC ..... F04B 1/124; F04B 1/126; F04B 1/2035; F03C 1/0605; F03C 1/0636; F03C 1/0652

USPC ..... 92/57, 71

See application file for complete search history.

(56) References Cited

U.S. PATENT DOCUMENTS

| | | | | |
|---|---|---|---|---|
| 3,999,468 | A * | 12/1976 | Bristow | F04B 1/124 92/248 |
| 5,681,149 | A * | 10/1997 | Weatherly | F04B 1/2042 92/57 |
| 5,970,845 | A * | 10/1999 | Beck | F04B 1/124 92/71 |
| 2016/0076524 | A1 * | 3/2016 | Tamashima | F04B 1/124 92/13 |

FOREIGN PATENT DOCUMENTS

| | | |
|---|---|---|
| DE | 196 10 595 C1 | 10/1996 |
| DE | 198 15 614 B4 | 9/2005 |
| DE | 10 2004 061 863 A1 | 7/2006 |
| DE | 10 2006 042 677 A1 | 1/2008 |
| DE | 10 2006 014 222 B4 | 10/2014 |

* cited by examiner

*Primary Examiner* — Michael Leslie

(74) *Attorney, Agent, or Firm* — Maginot, Moore & Beck LLP

(57) ABSTRACT

A hydrostatic positive-displacement machine, in particular a hydrostatic axial piston machine, having a cylinder drum with at least one cylinder, in which a longitudinally displaceable piston is received, which is supported directly or indirectly by a support portion on an inclined plane of the positive-displacement machine. An outer circumferential surface portion of the piston is in bearing contact with an inner circumferential surface portion of the cylinder.

16 Claims, 6 Drawing Sheets

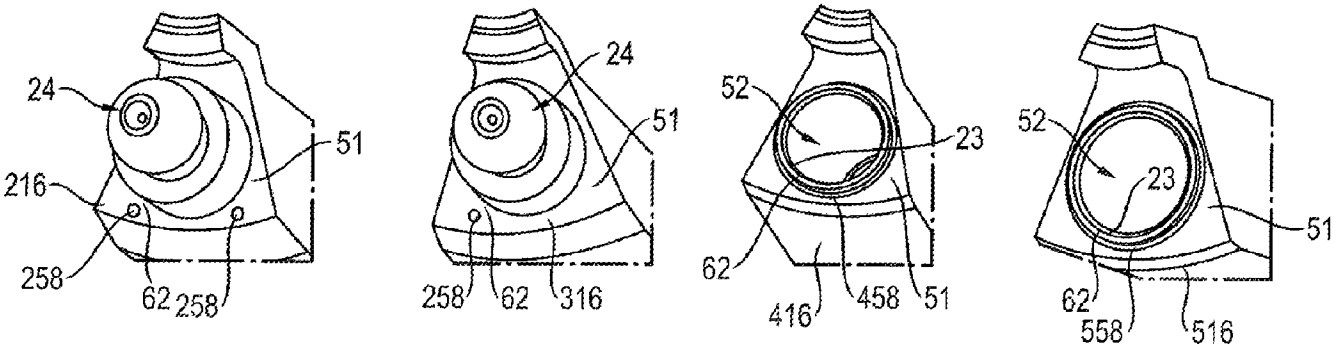
Fig. 4a
Fig. 4b
Fig. 4c
Fig. 4d
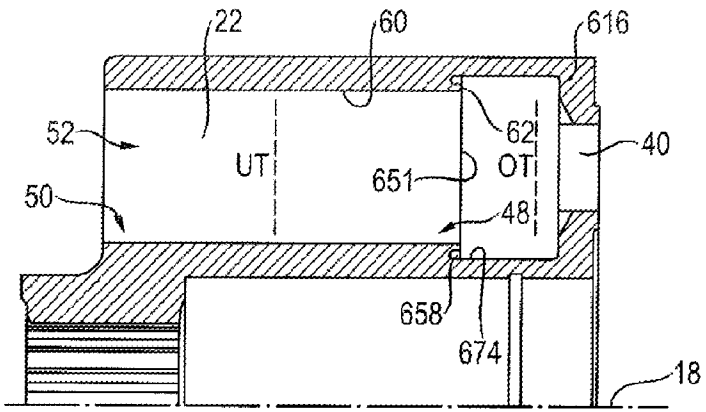
Fig. 5a

HYDROSTATIC POSITIVE-DISPLACEMENT MACHINE PISTON FOR THE HYDROSTATIC POSITIVE-DISPLACEMENT MACHINE, AND CYLINDER DRUM FOR THE HYDROSTATIC POSITIVE-DISPLACEMENT MACHINE

This application claims priority under 35 U.S.C. § 119 to patent application no. DE 10 2017 210 857.6, filed on Jun. 28, 2017 in Germany, the disclosure of which is incorporated herein by reference in its entirety.

The disclosure relates to a hydrostatic positive-displacement machine, a piston for the positive-displacement machine, and a cylinder drum for the positive-displacement machine.

BACKGROUND

Hydrostatic positive-displacement machines convert hydraulic power in the form of a product of fluid volumetric flow and pressure into mechanical power in the form of a product of torque and rotational speed, and vice-versa. For the power conversion hydrostatic working chambers of variable volume are required, which are defined by pistons. Here, a piston guided in a cylinder either slides against an inclined plane or is connected to the inclined plane by a ball joint. Both variants rely on supporting the piston against the inclined plane. This principle applies to radial piston machines, for example, to axial piston machines of swash-plate design or inclined axis design, to wobble-plate machines and to vane-type machines. A special feature of the latter is that the displacement work is performed not by the stroke of the piston in its cylinder, but by the variation in volume of a positive-displacement chamber, which extends radially between a cylinder drum and an eccentric outer ring, and circumferentially between two pistons guided in the cylinder drum. In radial piston machines the inclined plane is formed by a lifting cam, or more precisely lifting face, along which the piston slides, which is associated with periodic working strokes. An axial piston machine of swash-plate design comprises a rotating cylinder drum, in the cylinder bores of which working pistons are received, which on the other side are supported so that they slide on a swashplate. In the case of the axial piston machine of swashplate design said working pistons are connected by a ball joint to an end flange of a drive shaft set towards the axis of rotation of the cylinder drum, so that a rotationally fixed connection is produced between the cylinder drum and the inclined axis.

In each case, because of the inclined plane the pistons and the cylinders must absorb both the axial force acting in the direction of the piston longitudinal axis and a lateral force acting transversely or radially in relation to the piston longitudinal axis. This leads to heavy stressing of the circumferential surfaces of the piston and the associated cylinder, particularly in an area where the piston emerges from the cylinder, and in an area of the end portion of the piston permanently guided in the cylinder. Here high solid contact pressures occur between the tribologically paired piston and cylinder. Said extreme areas of the bearing contact are also referred to as guide runouts.

Such high solid contact pressures can lead to a high degree of wear and power losses. If measures such as high-grade materials and/or heat treatment and coating, for example, are taken to counter the wear, the resulting costs of the positive-displacement machine are high. If, on the other hand, an extended bearing contact, that is to say a larger guide length, is chosen in order reduce the solid contact pressures, this takes up more overall space.

Previously known solutions are guide runouts of the pistons or cylinders which are of rigid or solid design in the area of their runout edges. Disadvantages associated with this are a high weight, greater overall space and possibly increased costs.

In order to reduce the solid contact pressure at the guide runouts, the patent specification DE 10 2006 014 222 B4 proposes a working piston which changes from a cylindrical shape to a spherical shape according to the degree of heating. For this purpose, the working piston comprises a hollow internal space into which an expansion element having a higher coefficient of thermal expansion than the working piston is fitted. If the working piston heats up in operation due to friction, the expansion element expands and presses the outer circumferential surface of the working piston into a convexly spherical shape. In this way the stress loading in the area of the guide runouts is shifted away from a high surface unit pressure towards a greater contact area and a lower surface unit pressure. Disadvantages to this are the high jig/fixture and production engineering costs for the working piston, together with a relatively difficult design of the expansion element and difficulty in matching it to the working piston. Furthermore, this solution works satisfactorily only within a narrow operating range, since the resulting spherical convexity is able to compensate for deformation due to lateral forces only at the design temperature.

Patent specification DE 196 10 595 C1 proposes the application of convex chamfers or radiuses to the piston in the area of the guide runouts, which in principle takes up the idea of spherical convexity. These chamfers or radiuses have a constantly varying radius of curvature, which under the effect of the lateral force discussed leads to a more extensive contact of the tribological pairing in the area of the guide runouts. A disadvantage to this is that in producing the outer circumferential surface of the working piston it is necessary to depart from the easily produced, cylindrical shape, which incurs an increased production cost. Moreover, this type of spherical convexity is "fixed", regardless of the lateral force actually acting, so that this solution also is capable of optimally reducing the surface unit pressure only within narrow operating ranges.

SUMMARY

The object of the disclosure, by contrast, is to create a hydrostatic positive-displacement machine which is better protected against wear. Further objects are to create a piston and a cylinder drum for this positive-displacement machine which each serve to reduce the wear in the area of the guide runouts.

The first object is achieved by a hydrostatic positive-displacement machine as disclosed herein, the second object by a piston as disclosed herein, and the third object by a cylinder drum as disclosed herein. Advantageous developments of the disclosure are described in each of the dependent claims.

A hydrostatic positive-displacement machine comprises a cylinder drum having at least one cylinder, in which a longitudinally displaceable piston is received, which comprises a support portion, which is supported directly or indirectly on an inclined plane of the positive-displacement machine. The piston and its support on the inclined plane therefore in particular form a sliding joint between the cylinder drum and the inclined plane. The support may, in particular, be sliding or alternatively, in particular, rotationally fixed. At the same time an outer circumferential surface portion of the piston is in bearing contact, particularly bearing guide contact, with an inner circumferential surface portion of the cylinder. According to the disclosure, in at least one end area—relative in particular to the stroke direction of the piston—of the bearing contact, a weakening, which serves to reduce a rigidity of the circumferential surface connected to the weakening or a rigidity of a wall arranged between the weakening and the circumferential surface when subjected to a force transversely to the stroke direction, particularly when subjected to a lateral or radial force, is provided on the piston or on the cylinder drum or on both.

The reduced rigidity in the end area of the bearing contact, which may also be referred to as an end area of a piston guide in the cylinder or as a guide runout, serves to increase a deformation of the weakened circumferential surface portion under a given, incident lateral force. In other words, the circumferential surface at this site is less inflexible and due to its more extensive deformation conforms better to the opposing circumferential surface. As a result, a solid contact pressure in this area diminishes. As a result, any friction and in particular any wear there between piston and cylinder as parties to the friction is minimized. An accompanying factor is that the positive-displacement machine is more cost-effective to produce, since lower costs for high-strength materials, heat treatment and coating are incurred. In this way it is also possible to expand the operating parameter range, for example towards a higher power density of the positive-displacement machine. Owing to the reduced wear, less material needs to be used, which leads to a lower weight of the positive-displacement machine and moreover affords an advantage in terms of the overall space, which can result in an increased power density of the positive-displacement machine. The improved deformation serves to increase a surface area between the working cylinder and the working piston on which both a hydrostatic, a hydrodynamic and also a trapped oil-based pressure field can act. The solid friction between the two is thereby reduced compared to the prior art and instead a significantly reduced fluid friction acts on this larger surface area. The effect of this is to achieve a higher efficiency.

The following areas of the piston and the cylinder are possible end areas of the bearing contact or guide runouts, in each of which the weakening can be arranged. Here the references to "inside" and "outside" relate to the reciprocating movement of the piston, "inside" being defined in the inward travel direction and "outside" in the outward travel direction of the piston: an outer guide runout of the cylinder, for example an outer cylinder edge or outer orifice of the cylinder, over which the piston travels or out of which the piston emerges from the cylinder; an inner guide runout of the cylinder, for example an inner cylinder edge arranged in the cylinder; an outer guide runout of the piston, for example an outer piston edge or an outer piston portion, which sinks least into the cylinder or does not sink into the cylinder; an inner guide runout of the piston, for example an inner piston edge or an inner piston portion.

In this way, therefore, one, two, three or up to four guide weakened runouts are formed per cylinder and piston. Here, any combinations of the four said weakened guide runouts are possible.

Possible positive-displacement machines are: a radial piston machine, from the cylinder drum of which the piston emerges radially, the inclined plane being formed by an undulating lifting cam or lifting face, which is arranged radially to the rotor and along which the supported piston slides or rolls; an axial piston machine of swashplate design, from the rotating cylinder drum of which the piston emerges axially, the inclined plane being formed by an upright swashplate, on which the sliding piston is supported; an axial piston machine of inclined axis design, from the rotating cylinder drum of which the piston emerges axially, the inclined plane being formed by a flange of a rotating inclined axis set towards the axis of rotation of the cylinder drum, the piston being rotationally fixed to the flange; a wobble-plate machine, from the upright cylinder drum of which the piston emerges axially, the inclined plane being formed by a rotating swashplate, on which the sliding piston is supported; a vane cell machine, from the cylinder drum of which the piston emerges radially, the inclined plane being formed by a cam ring, which is formed eccentrically or double-eccentrically in relation to the rotor and on which the sliding piston is supported. Here—unlike in the aforementioned positive-displacement machines—a hydrostatic working chamber is not defined in the cylinder drum by the cylinder and its piston, but is defined radially and circumferentially by two pistons, an outside of the cylinder drum and an inside of the cam ring. The work of the vane cell machine results—unlike in the aforementioned machines—not from the reciprocating work of its pistons but from the reciprocating work of the mutually eccentric circumferential surfaces of the cylinder drum and the cam ring.

A development of the positive-displacement machine is designed as a hydrostatic piston machine, in particular as a radial piston machine, axial piston machine or wobble-plate machine, and comprises a cylinder drum having at least one working cylinder, in which a longitudinally displaceable working piston is received. The aforementioned piston is now basically a working piston which—unlike in the vane cell machine—serves for converting power. The working piston here is supported directly or indirectly by a support portion on an inclined plane of the piston machine, so that a rotational movement of the inclined plane can be translated into a stroke of the working piston (pump operation), or vice-versa, a stroke of the working piston into a rotation of the inclined plane (motor operation). The piston machine is, in particular, an axial piston machine of swashplate design, the inclined plane in particular being a swashplate, on which the sliding support portion is supported. Alternatively, the piston machine may be an axial piston machine of inclined-axis design, the inclined plane being a flange of an inclined axis, which is set towards the working piston and the working cylinder and on which the rotationally fixed support portion is supported. Alternatively, the piston machine may be a radial piston machine, the inclined plane being a circumferential lifting face, on which the sliding or rolling support portion is supported. An outer circumferential surface portion of the working piston is in bearing contact with an inner circumferential surface portion of the working cylinder. Apart from these portions the two circumferential surfaces in particular do not come into contact with one another. According to the disclosure a weakening, which serves to reduce a rigidity of the circumferential surface connected to this weakening when subjected to a lateral or radial force, is provided in at least one end area of this bearing contact on the working piston or on the cylinder drum or on both of these.

The reduced rigidity in the end area of the bearing contact, which may also be referred to as an end area of a working piston guide in the working cylinder or as a guide runout, serves to increase a deformation of the weakened circumferential surface portion under a given, incident lateral force.

In other words, the circumferential surface at this site is less inflexible and due to its more extensive deformation conforms better to the opposing circumferential surface. As a result, any solid contact pressure in this area diminishes. Consequently, any wear there between working piston and working cylinder as parties to the friction is minimized in this area. An accompanying factor is that the piston machine is more cost-effective to produce, since lower costs for high-strength materials, heat treatment and coating are incurred. In this way it is also possible to expand the operating parameter range, for example towards a higher power density of the piston machine. The overall effect is to achieve an altogether higher efficiency, since owing to a reduced use of material a lower weight of the piston machine can be achieved. Since, as stated, less material needs to be used, due to the reduced wear, this affords an advantage in terms of overall space, which can result in an increased power density of the piston machine. The improved deformation also increases an area on which a hydrodynamic pressure field acts between the working cylinder and the working piston.

In a development at least the one end area comprises an orifice of the working cylinder on the cylinder drum, from which the working piston emerges in the direction of the inclined plane. Alternatively or in addition, at least the one end area may be arranged in the opposite direction inside the working cylinder, where the working piston is run in to an average, submaximal or maximum extent. On the working piston, on the other hand, at least the one end area may be formed by an end portion which is arranged in the working cylinder and/or formed by an end portion which protrudes out of the working cylinder. The weakening according to the disclosure may naturally be provided on more than one such end areas in combination.

In a development at least the one weakening is formed in that it comprises a material different from the surrounding material and having different material characteristics, in particular a lower modulus of elasticity.

In a development at least the one weakening is formed in that it has a heat treatment different from the surrounding material.

In a development at least the one weakening is a topological weakening, for example in the form of a notch. The latter weakening, in particular, can be made in a very targeted way and by simple production engineering means.

Various types of weakening—different material, different heat treatment or topology—may naturally be combined with one another, so that, for example, different guide runouts comprise different types of weakenings.

In a development a wall is formed between the weakening and the circumferential surface. Here the weakening may be specifically adjusted via a thickness of the wall in a transverse or radial direction and a length of the wall in the stroke direction.

In a development the weakening is formed progressively in that the wall extends tapering, particularly in the stroke direction, particularly in the direction of the guide runout. Here the taper may be constant or stepped. It may, in particular, have a parabolic profile.

The positive-displacement machine, in particular a piston machine, is of particularly simple design if the one or both circumferential surfaces, despite the presence of a weakening, is/are of cylindrical formation. It is then possible, compared to the prior art, to dispense with an expensive spherically convex fabrication, for example of the outer circumferential surface of the piston, in particular the working piston. The cylindrical fabrication of the outer circumferential surface and the inner circumferential surface proves less expensive.

In end areas of the circumferential surfaces and/or the bearing contact the circumferential surfaces may comprise chamfers or radiuses or crowns supporting the weakening.

One advantage of the weakening according to the disclosure is that a deformation of the circumferential surface weakened thereby varies as a function of the load.

In a development the weakening extends from a plane or surface angled in relation to the circumferential surface, in particular from an end plane or end surface, in a stroke direction into the working piston or into the cylinder drum. Examples of the end face of the working piston here are the end portion already mentioned, sinking to the maximum extent into the working cylinder and situated opposite this, the end portion of the working piston which protrudes from the working cylinder and at which, for example, the outer circumferential surface terminates. Possibly starting at the latter end portion, for example, is the support portion, which in a preferred development is formed by a ball end of the working piston, which serves to support this on the inclined plane (swashplate, flange of the inclined axis, lifting face, depending on the type of piston machine). For the working cylinder, said end plane or end face is formed, for example, by an end face of the cylinder drum, into which the working cylinder is introduced, for example as a cylinder bore. This end face forms the orifice area of the working cylinder(s), from which the respective working piston emerges. Alternatively or in addition, the end face of the working cylinder may be arranged inside the working cylinder in an area in which the working piston sinks to its average, submaximal or maximum extent. Here the end face may be provided, for example, as an undercut in the form of an annular end face.

In a development, particularly of the topological weakening, the latter comprises a recess. The recess here may be a bore, in particular a blind hole bore, a milling, a groove, a gap or the like. Through the topology of the weakening it is possible to influence the way in which the deformation of the circumferential surface, thus weakened, varies as a function of the load.

In a development the weakening is coaxial, in particular concentric with a central axis of the piston or the cylinder, or alternatively eccentric in relation to the central axis. In the case of the piston a coaxial, concentric weakening, for example, can be provided by means of a central bore in the end portion of the piston arranged in the cylinder. In other words, the piston is hollow at this point. According to the disclosure the weakening may be intensified by additionally forming a circumferential groove and/or a circumferential chamfer on the annular end face produced on the piston in this way. The weakening may be eccentric on the piston, for example, when one or more bores are purposely applied to one of the two said end or annular end faces. Something similar may be provided on the end face of the cylinder drum surrounding the orifice of the cylinder.

In an alternative or supplementary development, the weakening extends asymmetrically or symmetrically in relation to a central axis of the piston or the cylinder, or in relation to a plane spanned by the axis of rotation of the cylinder drum and a piston axis, for example. The asymmetrical weakening purposely caters for cases in which the positive-displacement machine is operated in only one or two operating quadrants, in which the lateral force, resulting from the high pressure of the positive-displacement machine and acting on the piston, is always in the same direction. The asymmetrical variant, on the other hand, recommends itself for the operation of a positive-displacement machine in which a change occurs in the direction of the lateral force resulting from the high pressure. This is the case particularly for a positive-displacement machine in four-quadrant operation with particular quadrant changes.

The weakening may be or comprise a bore, for example, in particular a blind hole bore. This weakening may, in particular, be formed coaxially, in particular concentrically, or eccentrically (as described).

One development having a coaxial, in particular a concentric, weakening is a circumferentially extending groove, for example. The groove here may be formed around part of the circumference (asymmetrical weakening) or all round the circumference (symmetrical weakening).

In principle combinations of multiple, partially circumferential weakenings separated from one another or multiple fully circumferential, interconnected weakenings are possible.

A piston according to the disclosure, in particular a working piston, for a hydrostatic positive-displacement machine, in particular a piston machine, in particular a hydrostatic axial piston machine, which is designed according to at least one aspect of the preceding description, comprises an outer circumferential surface portion which can be brought into bearing contact with an inner circumferential surface portion of a cylinder, in particular a working cylinder of the positive-displacement machine. The piston may be received in the cylinder so that it is displaceable in the stroke direction. The piston moreover comprises a support portion for indirect or direct support on an inclined plane of the positive-displacement machine (swashplate, flange of an inclined axis, lifting face or outer ring, depending on aforementioned type). According to the disclosure a weakening is formed in an area of at least one end portion of the outer circumferential surface portion, relative to the stroke direction. This weakening serves to reduce a rigidity of this end portion when subjected to a lateral or radial force. The advantage to this is that the working piston according to the disclosure can be inserted into an existing positive-displacement machine or replaced. For a small outlay, therefore, an existing system can be adapted, reducing the wear between the piston and the cylinder of the positive-displacement machine in the manner described and even expanding an operating parameter range of the positive-displacement machine.

A cylinder drum according to the disclosure for a hydrostatic positive-displacement machine, in particular a piston machine, in particular a hydrostatic axial piston machine, which is designed according to at least one aspect of the preceding description, comprises at least one cylinder, in particular a working cylinder, in which a piston, in particular a working piston, of the positive-displacement machine can be received so that it is displaceable in the stroke direction. The piston in this case may obviously be the piston according to the disclosure, but also alternatively a conventional piston. The piston can be supported by a support portion on an inclined plane of the positive-displacement machine. According to the disclosure the cylinder of the cylinder drum is provided with an inner circumferential surface portion which is intended for bearing contact on an outer circumferential surface portion of the piston. Here, for reducing the rigidity, as already repeatedly discussed, a weakening is formed in an area of at least one end portion of the circumferential surface portion. This leads to a reduction in the rigidity of the end portion when subjected to a lateral or radial force. A recitation of the advantages afforded by the weakening according to the disclosure will be dispensed with here.

The weakening according to the disclosure may be applied to any piston and its cylinder in which it is guided. More generally, it may be applied to any sliding joint that comprises a guide element (cylinder) and a guided reciprocating element (piston) longitudinally displaceable therein. Featured here in particular, for example, are a cylinder and a piston of a hydrostatic adjusting device of said positive-displacement machine. The applicant reserves the right to address a set of claims to a sliding joint weakened in this way, in particular to an adjusting device weakened in this way.

BRIEF DESCRIPTION OF THE DRAWINGS

An exemplary embodiment of a hydrostatic axial piston machine according to the disclosure, multiple exemplary embodiments of a cylinder drum according to the disclosure and a working piston according to the disclosure are represented in the drawings. The disclosure is now explained with reference to the figures of these drawings, of which.

DETAILED DESCRIPTION

Figure 1:
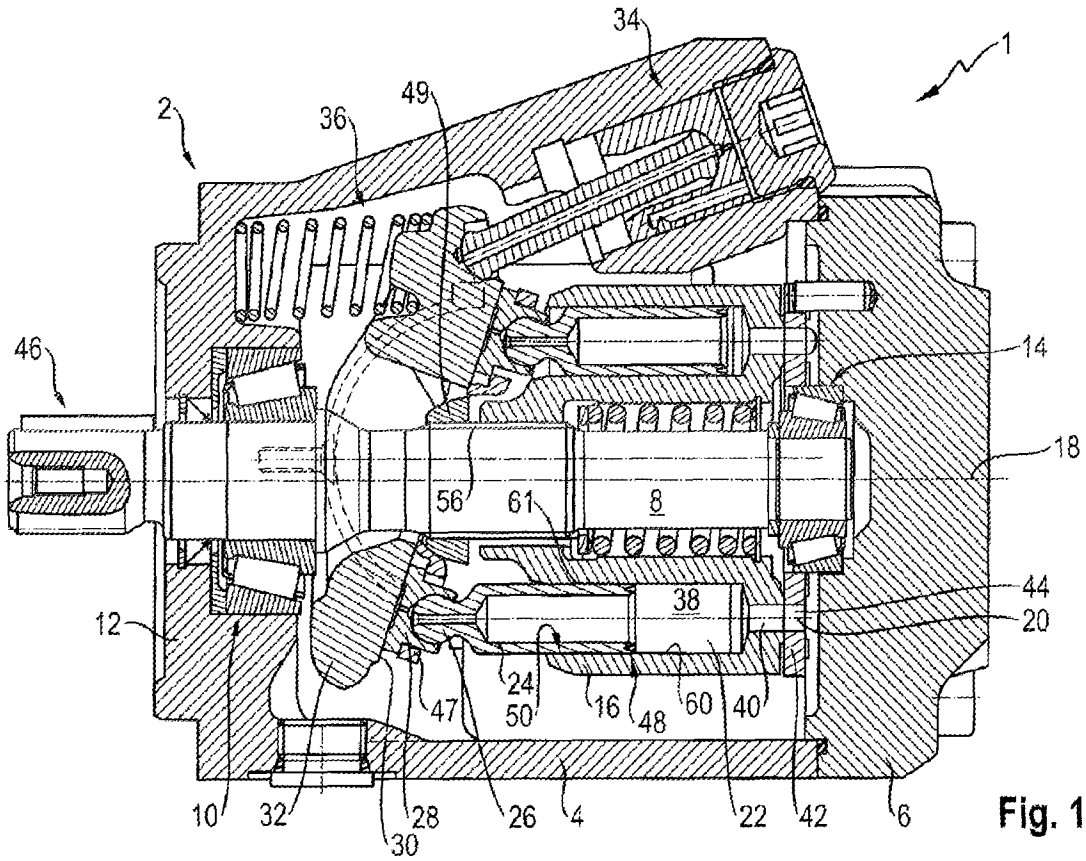
FIG. 1 shows a longitudinal section of a hydrostatic axial piston machine according to one exemplary embodiment.

FIG. 1 shows a hydrostatic axial piston machine 1 of swashplate design. This comprises a housing 2 having a canister-shaped housing part 4, which is closed by a housing cover 6, which comprises the hydraulic connections (not shown). A drive shaft 8 is rotatably supported in the housing 2, the support being provided on the one hand via a rolling-contact bearing 20 on a housing base 12 of the housing part 4 and on the other via a rolling-contact bearing 14 on the housing cover 6. Rotationally fixed to the drive shaft 8 is a cylinder drum 16, which on a pitch circle 20 arranged concentrically with an axis of rotation 18 comprises multiple bores or working cylinders 22, in each of which a longitudinally displaceable working piston 24 is arranged. The working pistons 24 each protrude with a neck and an adjoining piston head 26 from the working cylinder 22, the piston head being pivotably received in a sliding shoe 28. The latter is supported so that it slides on a swashplate 30. This in turn is formed on a cradle 32 which is pivotably supported in the housing 2.

A swivel angle of the cradle 32 is hydraulically adjustable via a hydrostatic adjusting device 34. A return device in the form of a spring 36 acts on the cradle 32 in opposition to the adjusting device 34. Added to this is a restoring moment resulting from the propulsive forces. In the unpressurized operating state, for example in starting, and with the adjusting device inoperative, this deflects the swashplate in the direction of a maximum swivel angle.

In the working cylinders 22 hydrostatic working chambers 38 are defined by the working pistons 24. At an end face of the cylinder drum 16 remote from the swashplate 20 these chambers each comprise an aperture 40, said end face being in bearing contact with a control plate 42 fixed to the housing. This control plate comprises passages in the form of reniform openings 44, which are each in constant hydraulic connection with one of the hydrostatic working connections of the housing cover 6 (not shown). Further details of the basic construction of the axial piston machine 1 can be dispensed with, since this technology is sufficiently known from the prior art.

In operation of the axial piston machine 1, assuming operation as a pump, a torque is transmitted to a shaft stub 46 of the drive shaft 8. This starts to rotate and the cylinder drum 16 turns with it. If the swashplate 32, as shown, is swiveled out of a neutral position, a working stroke, the dead centers of which are shown top and bottom in FIG. 1 by the working pistons represented 24, is imposed on the working pistons 24 as the drive shaft 8 rotates. A swivel angle of 0°, at which the plane of the swashplate 30 stands perpendicular to the axis of rotation 18, is here defined as neutral position. The neutral position is accordingly characterized by a zero-working stroke.

In a suction stroke between the dead center represented at the top and the dead center represented at the bottom, fluid is drawn in at the low-pressure connection (not shown) of the housing cover 6 by the working piston 24 running out of its working cylinder 22. This can happen in the pump operation discussed, since the sliding shoes 28 are forced onto the swashplate 30 by a hold-down device 47. This is followed, from the dead center represented at the bottom of FIG. 1, by the sliding shoe 28 sliding upwards on the swashplate 30, which according to the swivel angle represented causes the working piston 24 to run in towards the dead center represented at the top of FIG. 1. In so doing the fluid in the working chamber 38 is delivered by the shaft power of the drive shaft 8 and the running-in of the working piston 24 to the high-pressure connection of the housing cover 6 (not shown) where it is expelled. Acting on the sliding shoe 28 at the same time is a reaction force, which has one component perpendicular to the swashplate 30 and one parallel to the swashplate 30. Accordingly, the result, among other things, is a component force acting on the working piston 24 in the direction of its central axis and causing it to run in, and a lateral component force, which acts transversely thereto. The piston head 26 is subjected to this lateral force, which according to FIG. 1 acts at right-angles to the axis of rotation 18 as the working piston 24 runs in from top to bottom, as described. Other forces and moments also act, which impose a load on the sliding joint formed by the working piston 24 and working cylinder 22. Consequently, an inner circumferential surface 60 of the working cylinder 22 and an outer circumferential surface 61 of the working piston 24 are subjected to a high surface contact pressure, particularly in the area of an inner end portion 48 of the working piston 24 and an outer end portion 50 of the working cylinder 22. In order to reduce this, the axial piston machine 1 according to the disclosure is equipped with a working piston 24 according to the disclosure.

This and further exemplary embodiments of a working piston, together with a cylinder drum according to the disclosure are explained in more detail in the following figures.

In order to also safeguard the axial piston machine against wear to other heavily stressed components, according to FIG. 1, for example, the hold-down device 47 (return plate), the drive shaft 8, the control plate 42, the working pistons 24 (also applies to other exemplary embodiments), the piston heads 26 and the cradle 24 may be produced from nitrocarburized, oxidized steel. The cylinder drum 16 (also applies to other exemplary embodiments), the external and internal toothings of the drive shaft 8 and the cylinder drums 16, the slide shoes 28, together with a return ball or a thrust piece 49, which serves to impose a contact pressure on the hold-down device 47, may be sintered, for example.

Figure 2:
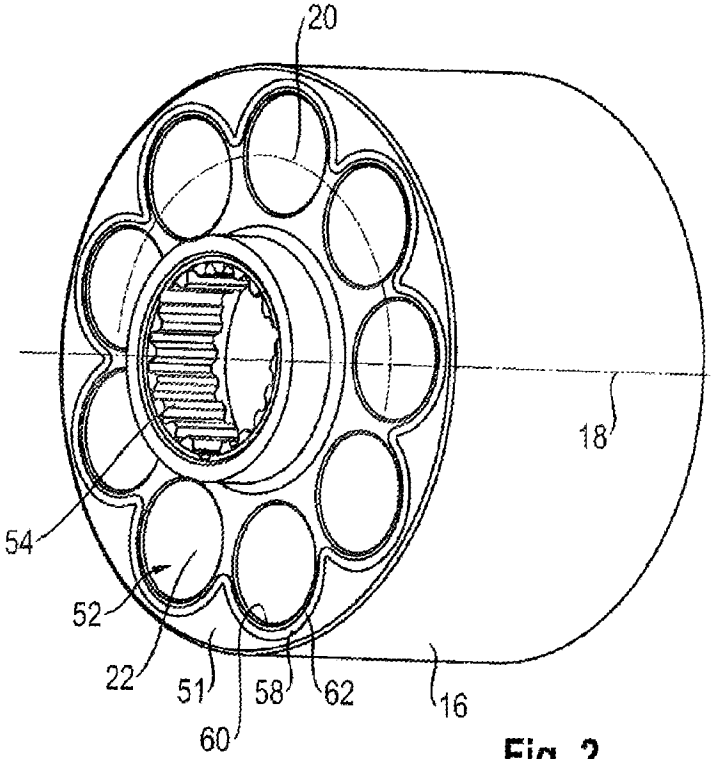
FIG. 2 shows a perspective view of a first exemplary embodiment of a cylinder drum.

The cylinder drums according to the disclosure will first be described with reference to FIGS. 2 and 3. In FIG. 2 the cylinder drum 16 according to FIG. 1 is represented in a perspective view, giving a clear view of a cradle-side end face 51, in which orifices 52 of the working cylinders 22 are arranged. For a better representation of the disclosure, the fitted working pistons 24 are in each case removed. The working cylinders 22 here are arranged on the pitch circle 20, which extends concentrically around the axis of rotation 18. Working cylinders 22 set towards the axis of rotation 18 are feasible. The cylinder drum 16 comprises an internal toothing 54 with which it can be brought into rotationally fixed engagement with the external toothing 56 according to FIG. 1.

As already mentioned, one problem particularly with highly-stressed piston machines with high working pressures is that the surface contact pressure in said end areas 48 and 50 according to FIG. 1 can be so high, owing to the large lateral forces, that severe wear occurs. A weakening 58 according to the disclosure, which is introduced into the end face 51 on the cylinder drum 16, counteracts this. The weakening 58 here is formed as a radially outer circumferential groove 58 around the orifices 52. Here the groove 58 surrounds part of the circumference of each of the orifices 52 with a circumferential angle of approximately 170°. This leaves a wall 62 between the groove 58 and an inner circumferential surface 60 of the working cylinders 22 which, compared to an unweakened portion of the end area 50 situated radially inside against the orifices 52, for example, has a significantly lower resistance to deformation under incident radial or lateral forces. This accordingly results, under lateral force loading of the working pistons 24, in a radially outward direction, relative to their longitudinal axis, in a yielding of the outer end area 50 or the wall 62 radially outwards and thereby in a greater surface area of the bearing contact, as already mentioned, and a reduced surface contact pressure between the working piston 24 and the working cylinder 22. Added to this are the increased hydrostatic and hydrodynamic pressure field, together with the trapped oil effect. The wear there is accordingly reduced, compared to a conventional design, for otherwise unchanged operating parameters.

Figure 3:
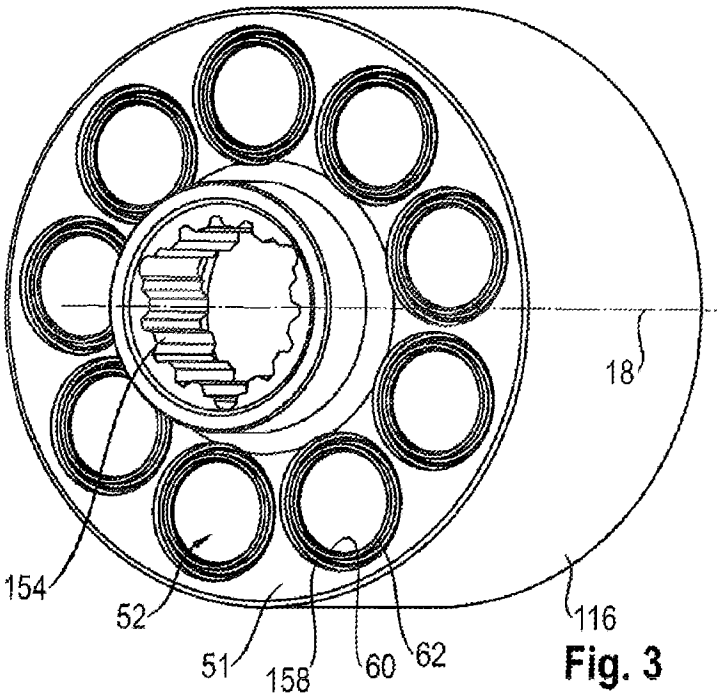
FIG. 3 shows a perspective view of a second exemplary embodiment of a cylinder drum, FIGS. 4*a* to 4*d* each show a detailed view of a third to sixth exemplary embodiment of a cylinder drum, and a second and third exemplary embodiment of a working piston, FIGS. 5*a* to 5*c* in a longitudinal section show a seventh to ninth exemplary embodiment of a cylinder drum, and FIGS. 6*a* to 6*e* each in a longitudinal section show a fourth to eighth exemplary embodiment of a working piston.

FIG. 3 shows a further exemplary embodiment of a cylinder drum 116 according to the disclosure. Unlike the exemplary embodiment according to FIG. 2, the cylinder drum 116 comprises an internal toothing 154 with three additional pressure pin recesses. In the area of the disclosure a weakening 158 differs from that according to FIG. 2 in that each of the individual orifices 52 is now ringed by a coaxial, in particular concentric groove 158, which is introduced into the end face 51. In this way the end area 50 of the inner circumferential surface 60 is weakened around the entire circumference of each orifice 52, that is to say for all possible load directions of the lateral force.

FIGS. 4*a* and 4*b* show further exemplary embodiments of cylinder drums 216 and 316 according to the disclosure in interaction with the working piston 24 according to FIG. 1, which is explained later. FIGS. 4*c* and 4*d* show two further exemplary embodiments of cylinder drums. According to FIG. 4*a* two radially outer weakenings 258, which are made as shallow blind-hole bores at a distance from the working cylinder 22, are introduced into the end face 51 of the cylinder drum 216. The two weakenings 258 are arranged and made symmetrically in relation to a plane spanned by the axis of rotation 18 and a central axis of the working piston 24. The underlying reason for this is that the weakenings 258 according to the disclosure are intended for a change in direction of the lateral force. This can occur, for example, if there is a switch between operating quadrants of the axial piston machine when, for example, the direction of the moment or the direction of rotation change. Furthermore, this weakening 258 may be advantageous if an edge chamfer of the working cylinder in the area where it opens into the face 51 is absent or small.

FIG. 4*b* shows an exemplary embodiment of a cylinder drum 316 having just one weakening 258, which like the weakening 258 according to FIG. 4*a* is made on the left. Accordingly, the cylinder drum 316 is only optimized for operation in which there is no change in the direction of the lateral force. Furthermore, this weakening 258 may be advantageous if an edge chamfer of the working cylinder in the area where it opens into the face 51 is absent or small.

FIGS. 4*c* and 4*d* show two cylinder drums 416 and 418 that are similar to one another. Both have a weakening which extends in a crescent shape around approximately half of the radially outer circumference of the orifice 52. Here the weakening 458;558 is designed as a groove, which has its deepest point or cross sections in the area of a radially outer apex of the orifice 52. The groove of the two weakenings 458;558 then runs radially inwards around the outside circumference of the orifice 52 and runs out flat approximately at an equator of the orifice 52 in the end face 51.

FIGS. 4*a* to 4*d* reveal the variety of ways in which operating requirements of the axial piston machine can be individually catered for through the arrangement and circumferential extent of the respective weakening 258,458, 558. Irrespective of the exemplary embodiments, the working cylinder 22 comprises an inner chamfer in the area of the orifice 52, that is to say in the end area 50 according to FIG. 1, so that damage to the outer circumferential surface 61 due to tilting, for example, can be excluded. This is particularly advantageous for the fitting of the working piston 24. This chamfer 23 is kept small, in order not to reduce the guide length too much. For reasons of clarity, this chamfer 23 is provided with reference numerals only in FIGS. 4*c* and 4*d*.

FIG. 5*a* shows a further exemplary embodiment of a cylinder drum 616 in a partial longitudinal section, so that one of the working cylinders 22 is represented in full section. The working cylinder 22 here extends between the aperture 40 and the orifice 52. The outer end area 50 of the bearing contact described above is arranged at the orifice 52. The inner end area 48 of the bearing contact is arranged between the orifice 52 and the aperture 40. Extending between the end areas 48,50, therefore is an inner circumferential surface portion of the inner circumferential surface 60, which comes into contact with the outer circumferential surface of the working piston 24. Unlike in the preceding exemplary embodiments, a weakening 658 of the cylinder drum 616 is now also formed on the inner end area 48, which reduces the rigidity of the inner circumferential surface 60, or more precisely its resistance to deformation, in this area, so that the inner circumferential surface 60 is better able to adjust to the lateral force imposed there by the working piston 24, the surface contact pressure is reduced and the hydrostatic and hydrodynamic pressure field and the trapped oil effect are increased. The weakening 658 in this exemplary embodiment is formed as a groove all around the circumference of an end face 651, formed as an undercut, inside the working cylinder 22. Here too, a wall 62, which owing to its relatively small width is more easily deformed when subjected to the lateral or radial force, again remains between the groove 658 and the inner circumferential surface 60. The end face here results from an interior clearance cut 674, radially expanded in relation to the inner circumferential surface 60. Here in this exemplary embodiment the working piston (not shown) sinks beyond the end area 48 to its maximum immersion depth, as is represented, for example, according to FIG. 1 for the top dead center of the upper working piston 24, as far as the right-hand dashed line and therefore travels over the end area 48. Its limit position corresponding to the bottom dead center corresponds to the left-hand dashed line in FIG. 5*a* in the area of the inner circumferential surface 60.

Figure 5B:
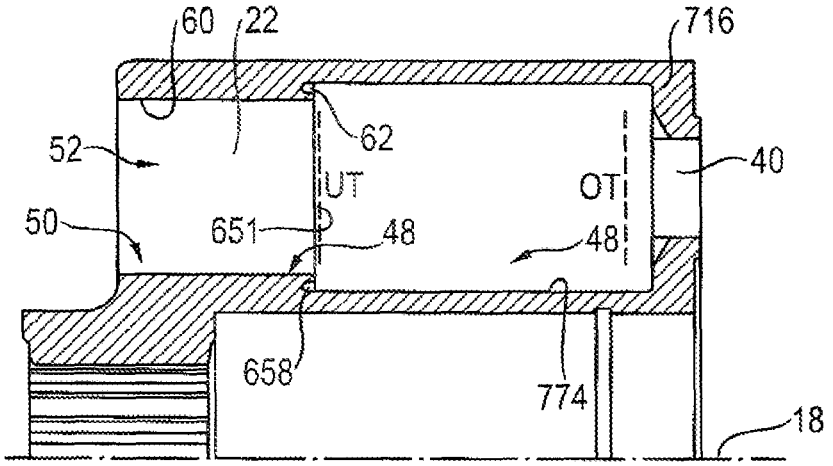

According to one exemplary embodiment shown in FIG. 5*b* a cylinder drum 716 has an even longer clearance cut 774 in an axial direction with the formation of an otherwise unchanged weakening 658. This clearance cut 774 is so long that both dead center limit positions of the working piston UT [BDC], OT [TDC] (dashed) lie inside the clearance cut 774. The stroke then no longer brings the inner edge of the working piston into contact with the inner circumferential surface 60 of the working cylinder 22; its wear-intensive "scraping" is prevented. The long clearance cut reduces the guide length. In the design configuration, therefore, it must be considered whether this is still sufficient to meet the operating stresses.

Figure 5C:
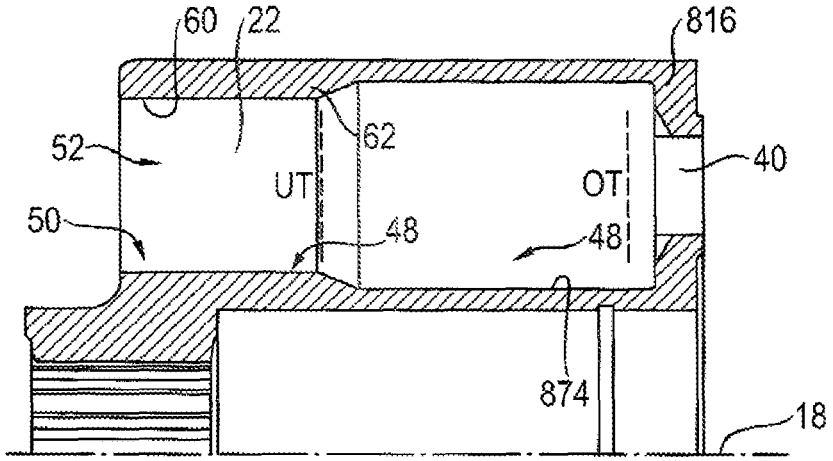

The exemplary embodiment according to FIG. 5*c* shows a cylinder drum 816 likewise having a longer clearance cut 874 in an axial direction than according to FIG. 5*a*, but without the formation of a weakening in the end area 48. Designed to then match this is a piston, particularly one weakened in the end area 48, according to FIGS. 6*a* to 6*d*. Here too, the clearance cut 874 is so long that both dead center limit positions of the working piston UT [BDC], OT [TDC] (dashed) lie inside the clearance cut 874.

An undercut in the working cylinder, over which the piston does not pass, is feasible as a further embodiment.

An embodiment in which the entire outer circumferential surface of the working piston is always inside the working cylinder, that is to say it never emerges from the working cylinder, is also possible. The optimum longitudinal guidance would be achieved here. Since this is difficult to achieve in practice, however, the weakening in the area of the orifice is to be recommended in cases where the outer circumferential surface of the working piston emerges, as is shown in FIGS. 2, 3 and 4, for example.

The geometrical ratios in the area of the weakening, and the weakening itself are preferably designed by FEM or EMD. The design process in particular produces geometrical ratios or dimensional ranges, a cross sectional profile of the wall 62 according to the required maximization of the contact surface.

FIGS. 6*a* to 6*e* show five further exemplary embodiments of a working piston 124; 224; 324; 424; 524 each in a longitudinal section. Common to all exemplary embodiments of the working pistons 24;124;224;324;424; 524 is the fact that they comprise a wide, coaxial, in particular concentric cylindrical hollow bore 64, which extends from the inner end area 48 almost to the outer end area 50. The weakening according to the disclosure of a piston or working piston can naturally also be applied to solid pistons. The hollow bore 64 makes the working piston 24;124;224;324; 424;524 particularly light, which leads to reduced inertial forces. Extending out of the hollow bore 64 is a heavily tapered passage 66, which opens out at a crown of the piston head 26. The piston head 26 in the sliding shoe 26, in which it is pivotably received, and the sliding shoe 28 on the swashplate 30 are hydrostatically relieved via the passage 66 in order to reduce the wear. As in the first exemplary embodiment of the working piston 24, the working piston 124 according to FIG. 6*a* in the area of the inner end area 48 has the weakening formed as a circumferential groove 658 in the annular end face there. Unlike the working piston 24, the working pistons 124; 224; 324; 424; 524 also have the groove 658 in the area of the outer end area 50, on a shoulder 68 formed as an annular end face. According to the disclosure, therefore, the outer circumferential surface 61 of the working piston 124 is weakened in both end areas 48 and 50. On the exemplary embodiment according to FIG. 6*a* a possible axial recessing tool 659 for producing the recess 658 and its position during production are sketched in. The same tool may also be used for producing the weakening 658 on the inner end area 48.

Figure 6A:
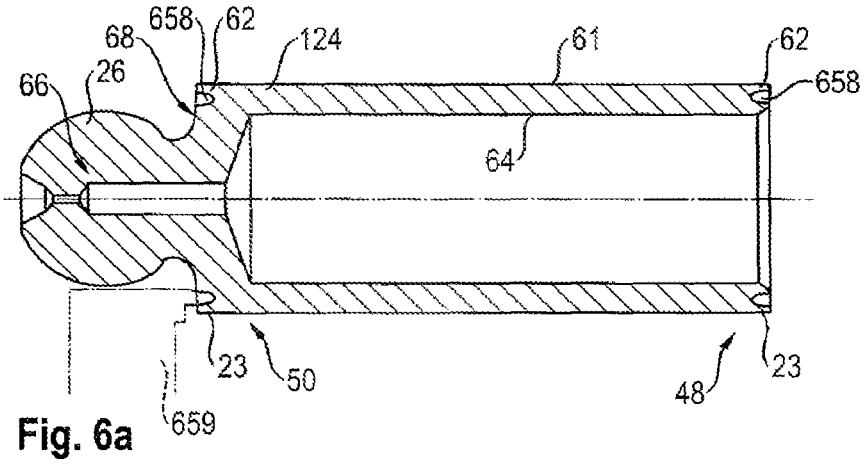
Figure 6B:
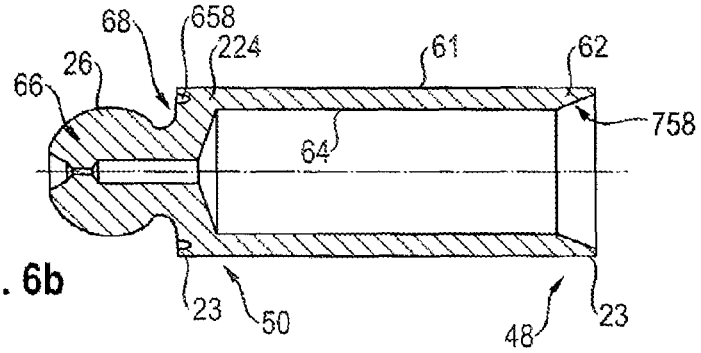
Figure 6C:
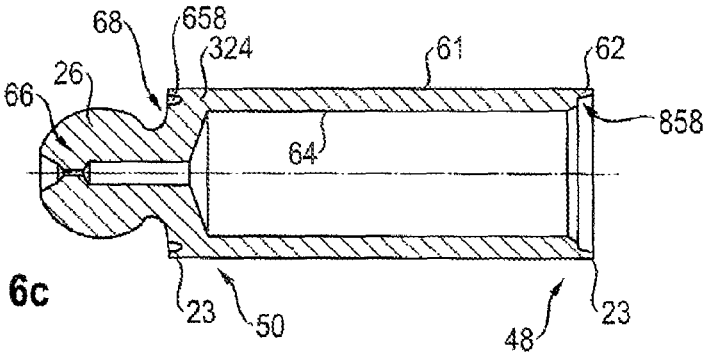

Unlike the working piston 124 according to FIG. 6*a*, in both of the working pistons 224 and 324 according to FIGS. 6*b* and 6*c* the weakening in the form of the groove 658 is dispensed with in the area of the inner end area 48 and instead a weakening 758; 858 is provided, in each case in the form of a highly pronounced inner chamfer. The inner chamfer 758 here extends at a constant angle; the inner chamfer 858 is stepped, extending at various angles.

Figure 6D:
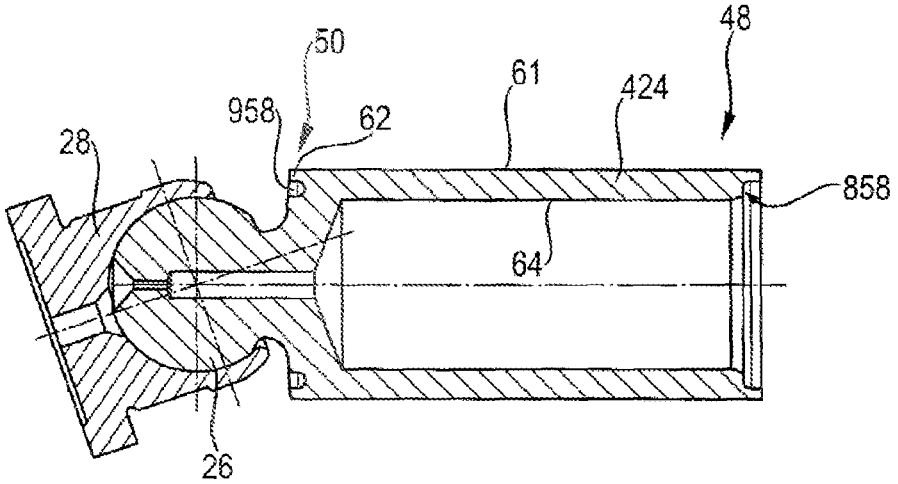

The exemplary embodiment according to FIG. 6*d* shows a working piston 424 with its piston head 26 in the sliding shoe 28. Unlike the working piston 324, the working piston 424 comprises an end-face weakening 958 in the outer end area 658 which has a more widely radiused groove base compared to the weakening 658. This reduces the notch effect of the weakening 958.

Figure 6E:
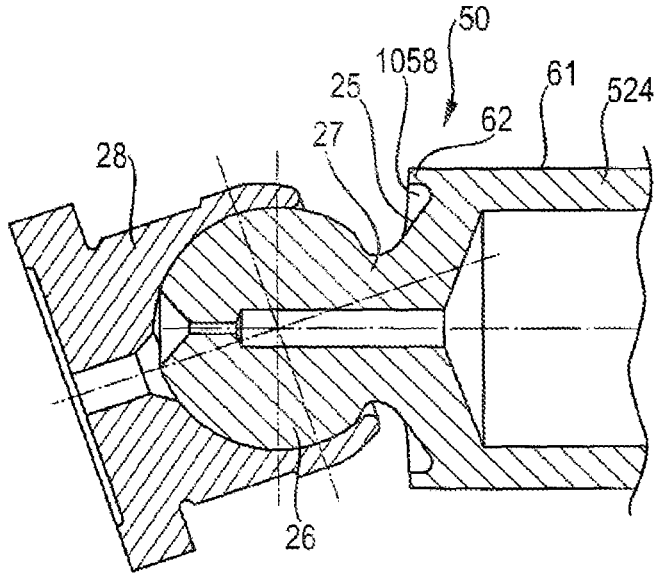

The exemplary embodiment according to FIG. 6*e* shows a working piston 524 which differs from the working piston 424 according to FIG. 6*d* in the weakening 1058 in the outer end area 50. The inner end area (not shown), on the other hand, is of identical design. The groove base of the weakening 1058 largely corresponds to that of the weakening 958 with a relatively large radius in order to reduce the notch effect. Unlike the last exemplary embodiment according to FIG. 6*d*, however, the groove base of the weakening 1058, merges tangentially radially inwards, rising in the direction of the piston head 26, into a shoulder 25, which rises towards a piston neck 27, on which the piston head 26 is seated.

In the case of the wall 62 that remains between the respective circumferential surface 60; 61 and the weakening 58; 158; 258; 358; 458; 558; 658; 758; 858; 958; 1058, care must be taken in the event of a subsequent heat treatment to ensure that it is of sufficient thickness, so that full hardening cannot ensue, thereby preventing brittle fracture at this point.

Wear can further be reduced if the circumferential surface (inner circumferential surface or outer circumferential surface) connected to the respective weakening is additionally provided with a micro-contouring, so that a converging contact gap results in the end area. In principle the wear can also be reduced by the creation of a more wear-resistant tribology. This can be done through the choice of material, a heat treatment, a coating, for example carbon-coating, or by the choice of a fluid improved by additives, for example. Wear can also be reduced by improving the surface quality of the working piston and working cylinder as said tribological pairing. Cooling, lubricant and relief pockets offer another general approach to cooling, lubrication and pressure relief by means of the fluid used. An optimization of the piston clearance between the working piston and the working cylinder can also reduce the wear. The same applies to an increase in the guide container, so that the bearing contact, that is to say the overlap of the outer circumferential surface portion and the inner circumferential surface portion is increased. Then the guidance of the working piston in the working cylinder is extended and the surface contact pressure in the end areas is reduced. Further advantages are afforded, for example, by using an insertable liner, especially one made of brass, to form the inner circumferential surface of the working cylinder.

In addition to the weakening according to the disclosure a reduction in the rigidity can be achieved by other design measures. For example, guide runouts of the piston and/or working cylinder can be designed to match one another, so that they cannot come into contact. A radially widened clearance cut or undercut in the working cylinder is feasible, for example, which in the stroke direction is of such long dimensions that the inner end portion of the piston moves exclusively in the clearance cut or undercut throughout its entire stroke. In this way the inner piston edge has no contact with the working cylinder and the wear-intensive "scraping" of the inner piston edge on the inner circumferential surface of the cylinder is impossible. This solution is appropriate, for example, if the guide situation of the working piston in the working cylinder is not thereby critically impaired due to a resulting, shorter guide length or by diverging guide clearances.

In principle any combination of the exemplary embodiments of weakenings is possible.

A hydrostatic positive-displacement machine is disclosed, in particular a piston machine, in particular an axial piston machine of swashplate design, having a cylinder drum, in at least the one cylinder, particularly working cylinder, of which, a piston, in particular working piston, subjected to lateral forces, is axially guided. Here an inner circumferential surface of the cylinder and an outer circumferential surface of the piston each comprise a guide portion, the guide portions being the portions of the two surfaces which come into bearing contact with one another. According to the disclosure at least one end area of at least one of the guide portions comprises a weakening, which serves to reduce its rigidity in respect of stress loading by a lateral force.

A piston is moreover disclosed, in particular a working piston, for a positive-displacement machine, in particular a piston machine, at least one end area of its guide portion comprising a weakening, which serves to reduce its rigidity in respect of stress loading by a lateral force. A cylinder drum is also disclosed having at least one cylinder, in particular a working cylinder, for receiving a piston, in particular a working piston, at least one end area of a guide portion of the cylinder comprising a weakening, which serves to reduce its rigidity in respect of stress loading by a lateral force.

LIST OF REFERENCE NUMERALS

1 hydrostatic axial piston machine
2 housing
4 housing canister
6 housing cover
8 drive shaft
10 rolling-contact bearing
12 housing base

14 rolling-contact bearing
16;116;216; cylinder drum
316;416;516;
616;716;816
18 axis of rotation
20 piston longitudinal axis/pitch circle
22 working cylinder
23 chamfer
24;124;224; working piston
324;424;524
25 shoulder
26 piston head
27 piston neck
28 sliding shoe
30 swashplate
32 cradle
34 adjusting device
36 return device
38 hydrostatic working chamber
40 aperture
42 control plate
44 passage
46 shaft stub
47 hold-down device
48,50 end area
49 return ball
51;651 end face
52 orifice
54;154 internal toothing
56 external toothing
58;158;258; weakening
458;558;658;
758;858;1058
60 inner circumferential surface
61 outer circumferential surface
62 wall
64 hollow bore
66 passage
68 shoulder
70,72 inner chamfer
659 axial recessing tool
674;774;874 clearance cut

What is claimed is:

1. A hydrostatic positive-displacement machine comprising:

a longitudinally displaceable piston;

a support portion; and a cylinder drum having at least one cylinder configured to receive the piston, wherein the piston is supported directly or indirectly by the support portion on an inclined plane of the positive-displacement machine, wherein an outer circumferential surface portion of the piston is in bearing contact with an inner circumferential surface portion of the at least one cylinder, and wherein, in at least one end area of the bearing contact, a weakening is formed in at least one of the piston and the cylinder drum, the weakening configured to reduce a rigidity or a resistance to deformation of a circumferential surface connected to the weakening when subjected to a lateral or radial force, wherein the weakening is defined as at least one of a recess, groove, and hole extending axially into an axially-facing surface of the at least one of the piston and the cylinder drum.

2. The positive-displacement machine according to claim 1, wherein the at least one cylinder is a working cylinder and the piston is a working piston.

3. The positive-displacement machine according to claim 1, wherein a wall is located between the weakening and the connected circumferential surface.

4. The positive-displacement machine according to claim 3, wherein the wall tapers in a stroke direction of the piston.

5. The positive-displacement machine according to claim 1, wherein the connected circumferential surface is predominantly cylindrical.

6. The positive-displacement machine according to claim 1, wherein the weakening comprises at least one recess defined in the axially-facing surface.

7. The positive-displacement machine according to claim 1, wherein the weakening extends concentrically or eccentrically with respect to a central axis of the piston or the at least one cylinder.

8. The positive-displacement machine according to claim 1, wherein the weakening extends rotationally asymmetrically or rotationally symmetrically in relation to a central axis of the piston or the at least one cylinder.

9. The positive-displacement machine according to claim 1, wherein the weakening comprises at least one groove defined in the axially-facing surface and extending around a circumference of the circumferential surface.

10. The positive-displacement machine according to claim 9, wherein the weakening extends around part of the circumference or all of the circumference.

11. A hydrostatic positive-displacement machine comprising:

a longitudinally displaceable piston;

a support portion; and a cylinder drum having at least one cylinder configured to receive the piston, wherein the piston is supported directly or indirectly by the support portion on an inclined plane of the positive-displacement machine, wherein an outer circumferential surface portion of the piston is in bearing contact with an inner circumferential surface portion of the at least one cylinder, and wherein, in at least one end area of the bearing contact, a weakening configured to reduce a rigidity or a resistance to deformation of a circumferential surface connected to the weakening when subjected to a lateral or radial force, is provided on the piston, the cylinder drum, or both, and wherein the weakening comprises a blind-hole bore.

12. The positive-displacement machine according to claim 11, wherein the blind-hole bore extends from a plane or surface, angled in relation to the connected circumferential surface, into the piston or the cylinder drum.

13. A piston for a hydrostatic positive-displacement machine, comprising:

an outer circumferential surface portion configured to be brought into bearing contact with an inner circumferential surface portion of a cylinder of the positive-displacement machine, in which the piston is received in such a way that the piston is displaceable in a stroke direction;

a support portion configured for support on an inclined plane of the positive-displacement machine; and a weakening defined in an area of at least one end portion of the outer circumferential surface portion and configured to reduce a rigidity of the at least one end portion when subjected to a lateral or radial force, wherein the weakening is defined as at least one of a recess, groove, and hole extending axially into an axially-facing surface of the piston.

14. A cylinder drum for a hydrostatic positive-displacement machine, comprising:

at least one cylinder in which a piston of the positive-displacement machine can be received so that the piston is displaceable in a stroke direction and is supported by a support portion on an inclined plane of the positive-displacement machine, the at least one cylinder comprising an inner circumferential surface portion configured for bearing contact on an outer circumferential surface portion of the piston; and a weakening formed in an area of at least one end portion of the inner circumferential surface portion and configured to reduce a rigidity of the end portion when subjected to a lateral or radial force, wherein the weakening is defined as at least one of a recess, groove, and hole extending axially into an axially-facing surface of the cylinder drum.

15. A cylinder drum for a hydrostatic positive-displacement machine, comprising:

at least one cylinder in which a piston of the positive-displacement machine can be received so that the piston is displaceable in a stroke direction and is supported by a support portion on an inclined plane of the positive-displacement machine, the at least one cylinder comprising an inner circumferential surface portion configured for bearing contact on an outer circumferential surface portion of the piston;

a weakening formed in an area of at least one end portion of the inner circumferential surface portion and configured to reduce a rigidity of the end portion when subjected to a lateral or radial force;

an end face in which the at least one cylinder opens out; and a plurality of orifices, wherein a respective weakening extends completely around a circumference of each orifice of the plurality of orifices.

16. A cylinder drum for a hydrostatic positive-displacement machine, comprising:

at least one cylinder in which a piston of the positive-displacement machine can be received so that the piston is displaceable in a stroke direction and is supported by a support portion on an inclined plane of the positive-displacement machine, the at least one cylinder comprising an inner circumferential surface portion configured for bearing contact on an outer circumferential surface portion of the piston;

a weakening formed in an area of at least one end portion of the inner circumferential surface portion and configured to reduce a rigidity of the end portion when subjected to a lateral or radial force;

an end face in which the at least one cylinder opens out; and a plurality of orifices, wherein weakenings extend around part of a radially inner or a radially outer circumference of the orifices of the plurality of orifices, and wherein the weakenings are either connected or isolated.

* * * * *